US007811100B2

(12) United States Patent
Stoner

(10) Patent No.: US 7,811,100 B2
(45) Date of Patent: Oct. 12, 2010

(54) ELECTRICAL CONNECTOR SYSTEM HAVING A CONTINUOUS GROUND AT THE MATING INTERFACE THEREOF

(75) Inventor: Stuart Craig Stoner, Lewisberry, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 158 days.

(21) Appl. No.: 12/129,086

(22) Filed: May 29, 2008

(65) Prior Publication Data

US 2009/0017652 A1 Jan. 15, 2009

Related U.S. Application Data

(60) Provisional application No. 60/949,541, filed on Jul. 13, 2007.

(51) Int. Cl.
*H01R 4/66* (2006.01)

(52) U.S. Cl. ..... 439/108; 439/660; 439/181

(58) Field of Classification Search ..... 439/108, 439/181, 65, 660
See application file for complete search history.

(56) References Cited

U.S. PATENT DOCUMENTS 4,681,549 A * 7/1987 Peterson ..... 439/181
4,932,888 A 6/1990 Senor
5,522,738 A * 6/1996 Lace ..... 439/669
5,564,949 A 10/1996 Wellinsky
5,664,968 A 9/1997 Mickievicz
6,224,432 B1 5/2001 Billman
6,273,759 B1 8/2001 Perino et al.
6,375,474 B1 4/2002 Harper, Jr. et al.
6,554,640 B1 4/2003 Koike et al.
6,749,468 B2 6/2004 Avery
6,981,883 B2 1/2006 Raistrcik et al.
6,994,569 B2 2/2006 Minich et al.
7,207,836 B2 4/2007 Tsai
7,247,050 B1 7/2007 Minich
2005/0196987 A1* 9/2005 Shuey et al. ..... 439/108

* cited by examiner

*Primary Examiner*—Tho D Ta
(74) *Attorney, Agent, or Firm*—Woodcock Washburn LLP

(57) ABSTRACT

A connector interface may include an arrangement of contacts in a first connector, and a corresponding, complementary arrangement of contacts in a second connector mating with the contacts of the first connector. The contacts may be signal contacts or ground contacts. When the connectors are mated, a ground may be established between the connectors by the mating of the ground contacts from the respective connectors. The ground contacts in the first connector may be shaped to bridge together an array of ground contacts in the second connector when the connectors are mated. Such bridging tends to establish a continuous ground along the array of ground contacts, creating a more robust ground than in an otherwise identical connector.

20 Claims, 6 Drawing Sheets

ELECTRICAL CONNECTOR SYSTEM HAVING A CONTINUOUS GROUND AT THE MATING INTERFACE THEREOF

CROSS-REFERENCE TO RELATED APPLICATIONS

This application claims benefit under 35 U.S.C. §119(e) of provisional U.S. patent application No. 60/949,541, filed Jul. 13, 2007, the disclosure of which is incorporated herein by reference in its entirety.

BACKGROUND

Electrical connectors provide signal connections between electronic devices using signal contacts. Often, undesirable interference, or crosstalk, exists between neighboring signal contacts. A common approach to reducing crosstalk includes interspersing ground contacts among the signal contacts. However, at certain frequencies, signals may tend to "jump" through or across ground contacts, which may contribute to mistransmission and signal errors that are detrimental to the operation of the circuits and the connector.

Frequency domain techniques may be helpful to measure and evaluate the signal loss and crosstalk characteristics of a connector system over a range of frequencies. Viewing crosstalk in the frequency domain shows the measure of crosstalk energy on individual frequencies of interest, e.g., the data rate and significant harmonics. It should be understood that spikes in frequency domain crosstalk are undesirable, as the spikes may indicate spurious voltages between grounds at particular frequencies.

One known approach for addressing such spikes is to fabricate connector leadframe housings from a carbon-impregnated plastic. Though such connectors are advertised to have low frequency domain crosstalk, even in a data-transfer-rate range of about 10-20 Gigabits/sec, the use of carbon-impregnated plastic makes such connectors relatively expensive. It would be desirable, therefore, if there were low-cost solutions that address the problem of spikes in frequency domain crosstalk.

SUMMARY

A connector interface may include an arrangement of blade-shaped contacts on a header connector, and a corresponding, complementary arrangement of receptacle contacts on a receptacle connector mating with the blades. The contacts may be positioned in the connectors in an arrangement of signal contacts and ground contacts. For example, a linear array of contacts may be arranged with a signal-ground-signal-ground arrangement, a signal-signal-ground arrangement, or a signal-signal-ground-ground arrangement. The contacts in each linear array may be positioned edge-to-edge and housed in a respective leadframe assembly. Each contact may be positioned broadside-to-broadside with a corresponding contact in an adjacent leadframe assembly. It should be understood, however, that the contacts within a leadframe assembly may be positioned broadside-to-broadside with each other, and positioned edge-to-edge with corresponding contacts in an adjacent leadframe assembly.

When the connectors are mated, a ground may be established between the connectors due to the mating of ground contacts from the respective connectors. Intermittent ground planes may be established at the contact mating surfaces where the broadsides of the receptacle ground contacts engage the broadsides of the header ground blades. Further, the receptacle ground contacts may be shaped to bridge together an array of header ground blades when the connectors are mated. Such bridging tends to establish a continuous ground along the array of mated ground contacts, thereby creating a more robust ground than in an otherwise identical connector. The continuous ground established along the array of mated ground contacts may extend along a direction that is perpendicular to the direction in which the contacts are arrayed in the leadframe assemblies.

In such a connector, frequency domain crosstalk tends to be lower than in an otherwise identical connector without such a continuous ground. Thus, spikes in the frequency domain crosstalk of a connector may be reduced by employing the bridging techniques disclosed herein. Also, electrical properties of a connector, such as signal integrity, for example, may be improved by establishing such a continuous ground.

DETAILED DESCRIPTION OF ILLUSTRATIVE EMBODIMENTS

Figure 1:
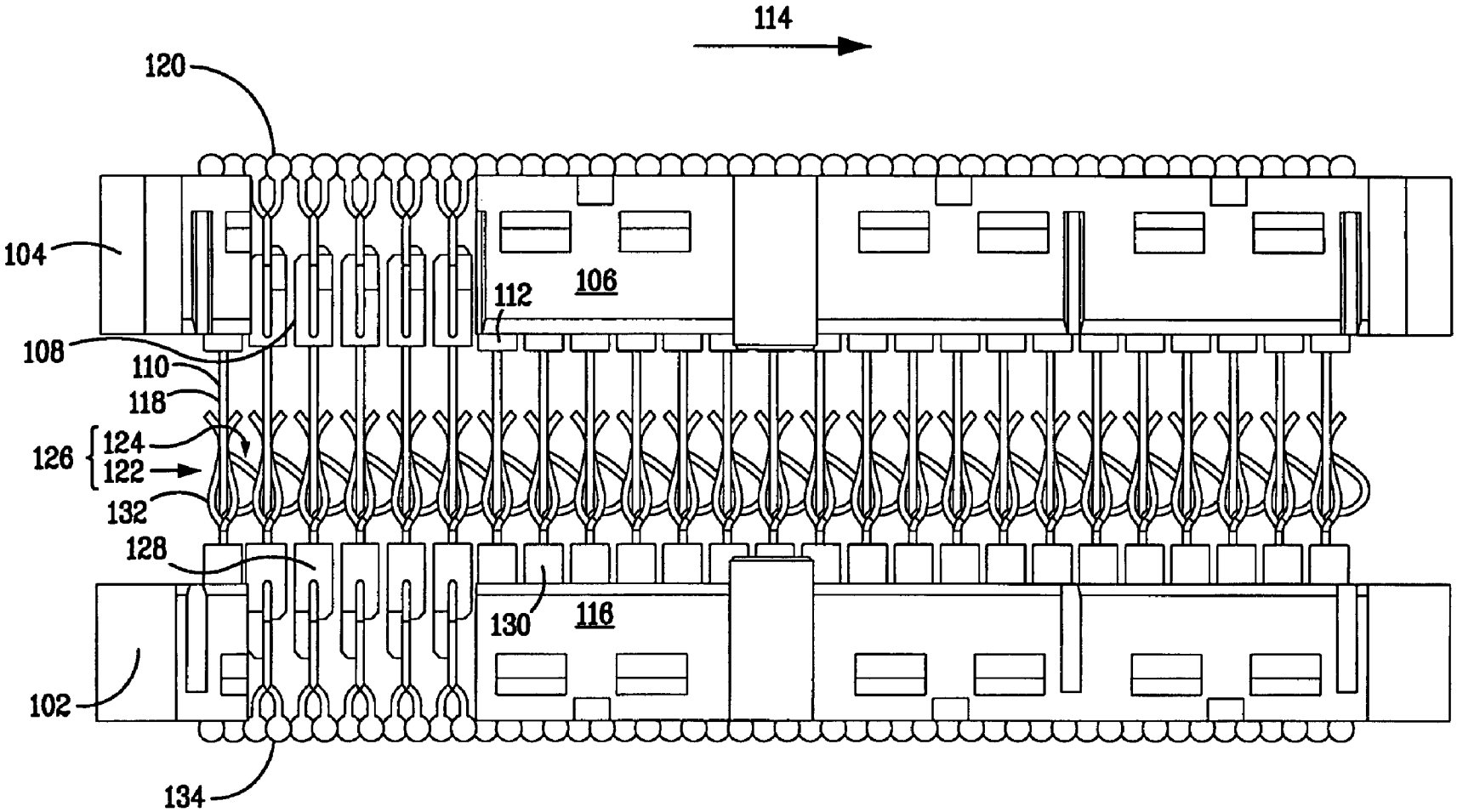
FIG. 1 depicts an electrical connector system having electrical contacts of a first connector mated to electrical contacts of a second connector.

FIG. 1 depicts a first electrical connector 102 mated to a second electrical connector 104, absent a top portion of each connector housing to show the mating interface. The mated electrical connectors 102, 104 may provide a connectable interface between one or more substrates, e.g., printed circuit boards. For example, the first connector 102 may be mounted to a first substrate, such as a printed circuit board, and the second connector 104 may be mounted to a second substrate, such as a printed circuit board. The connectors 102, 104 may be high-speed electrical connectors, i.e., connectors that operate at data transfer rates in excess of 1 Gigabit/sec, and typically at 10-20 Gigabits/sec or more. There is a well-known relationship between data transfer rate (also called "bit rate") and signal rise time. That is, rise time≈0.35/bandwidth, where bandwidth is approximately equal to one-half of the data transfer rate.

The first connector 102 and the second connector 104 are shown as vertical connectors. That is, the first connector 102 and the second connector 104 each define mating planes that are generally parallel to their respective mounting planes. The embodiments depicted herein show the first connector 102 as a receptacle connector and the second connector 104 as a header connector. It should be understood that either the first or second electrical connectors 102, 104 could be a header connector or a receptacle connector, and both of the first and second electrical connectors 102, 104 can be right-angle or mezzanine connectors.

The header connector 104 may include a connector housing 106 and electrical contacts 110 extending therethrough. The electrical contacts 110 may be arranged in an arrays in the header connector 104. Each contact 110 may have a cross-section that defines two opposing edges and two opposing broadsides. For example, the contacts 110 may be positioned broadside-to-broadside in a linear array along a first direction 114 and edge-to-edge in a linear array in a second direction that is perpendicular to the first direction 114. FIG. 1 depicts a linear array of contacts 110 positioned broadside-to-broadside in the first direction 114, showing the edge of each electrical contact 110 in the linear array. Each contact 110 shown may be the first contact in an array of contacts positioned edge-to-edge, the array extending in the second direction (i.e., a direction going into the page of FIG. 1). The electrical contacts 110 may include both signal contacts and ground contacts that vary in size and arrangement. For example, along each array extending in the second direction or along each array extending in the first direction, the contacts may be in a signal-ground-signal arrangement, a ground-signal-ground-signal arrangement, or a ground-signal-signal arrangement.

The header connector 104 may include a plurality of insert molded leadframe assemblies (IMLAs) 108 positioned adjacent to one another in the header connector housing 106. Each IMLA 108 may include a leadframe housing 112 through which the contacts 110 at least partially extend. The leadframe housing 112 may be made of a dielectric material, such as plastic, for example. The electrical contacts 110 may be housed in each IMLA 108 in a linear array that extends in the first direction 114 or in the second direction that is perpendicular to the first direction. In FIG. 1, the electrical contacts arrayed in each IMLA 108 in the second direction (i.e., a direction going into the page of FIG. 1), where each contact 110 shown is one contact in the array of contacts positioned edge-to-edge in the IMLA 108. The broadsides of each contact 110 in each IMLA 108 may be adjacent to the broadside of another contact 110 from an adjacent IMLA 108, thereby creating the array of contacts shown positioned broadside-to-broadside along the first direction 114 in FIG. 1.

Each of the contacts 110 in the header connector may have a respective mating portion 118 and a respective mounting portion 120. The mounting portions 120 may be suitable for any surface-mount or through-mount application. The mounting portions 120 may be compliant tail ends, or they may include fusible mounting elements, such as solder balls. The mounting portions 120 of the contacts may form a ball grid array (BGA) and electrically connect with apertures on a substrate face. The mating portion 118 of each electrical contact 110 may be blade-shaped and may mate with a respective electrical contact (e.g., 122, 124) of the receptacle connector 102.

The receptacle connector 102 may each include a connector housing 116 and electrical contacts 126 extending therethrough. The electrical contacts 126 may be of varying shapes and sizes, as shown by example contacts 122 and 124. The electrical contacts 126 may be arranged in arrays in the receptacle connector 102. Each contact 126 may have a cross-section that defines two opposing edges and two opposing broadsides. For example, like contacts 110, contacts 126 may be positioned broadside-to-broadside in a linear array along a first direction 114 and edge-to-edge in a linear array in a second direction that is perpendicular to the first direction 114.

FIG. 1 depicts a linear array of receptacle contacts 122 positioned broadside-to-broadside in the first direction 114, showing the edge of each electrical contact 122. Each contact 122 shown may be the first contact in an array of contacts positioned edge-to-edge, the array extending in the second direction (i.e., a direction going into the page of FIG. 1). A second linear array of receptacle contacts 124 is partially shown, the contacts in the second linear array also positioned broadside-to-broadside in the first direction. The electrical contacts, collectively 126, may include both signal contacts and ground contacts that vary in size and arrangement. For example, for each array extending along each direction, the contacts 126 may be in a signal-ground-signal arrangement, a ground-signal-ground-signal arrangement, or a ground-signal-signal arrangement.

The receptacle connector 102 may include a plurality of insert molded leadframe assemblies (IMLAs) 128 positioned adjacent to one another in the receptacle connector housing 116. Each IMLA 128 may include a leadframe housing 130 through which the contacts 126 at least partially extend. The leadframe housing 130 may be made of a dielectric material, such as plastic, for example. The electrical contacts 126 may be housed in each IMLA 108 in a linear array that extends in the first direction 114 or second direction that is perpendicular to the first direction. In FIG. 1, the electrical contacts 126 are arrayed in each IMLA 108 in the second direction (i.e., a direction going into the page of FIG. 1), where each contact 122 shown is one contact in the array of contacts positioned edge-to-edge in each IMLA 108. Each of the contacts 124 partially shown are positioned edge-to-edge with an adjacent contact 122 in each of those arrays. The broadsides of each contact 126 in each IMLA 128 may be adjacent to the broadside of another contact 126 from an adjacent IMLA 128, thereby creating the array of contacts positioned broadside-to-broadside along the first direction 114.

Each of the contacts 126 in the receptacle connector may have a respective mating portion 132 and a respective mounting portion 134. The mounting portions 134 may be suitable for any surface-mount or through-mount application. The mountings portions 134 may be compliant tail ends, or they may include fusible mounting elements, such as solder balls. The mounting portions 134 of the contacts may form a ball grid array (BGA) and electrically connect with apertures on a substrate face.

The mating portion 132 of each of the receptacle contacts 126 may be any shape that may receive or otherwise engage with a complementary contact, such as the contacts 110 of the header connector 104. For example, the mating portion 132 of a receptacle contact 122 may include a receptacle for receiving a male contact. FIG. 1 depicts two possible receptacle contacts 122, 124 with varying shapes, each which may mate with a contact 110 of the header connector 104 that are blade-shaped.

Figure 2A:
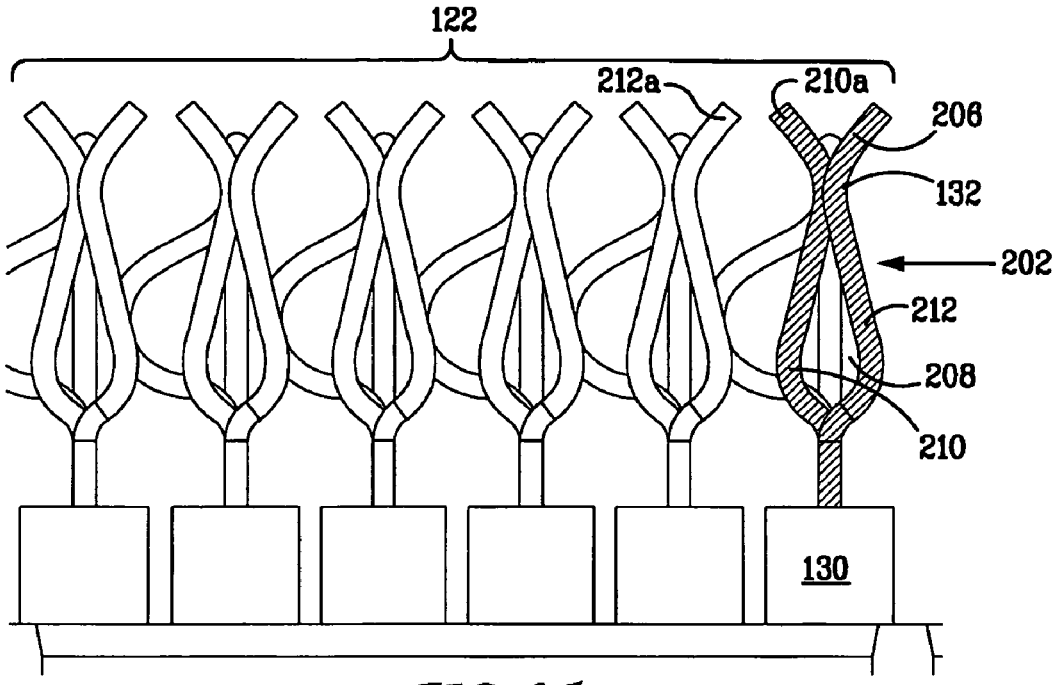
FIGS. 2A and 2B depict example electrical contacts of the first connector shown in FIG. 1.
Figure 2B:
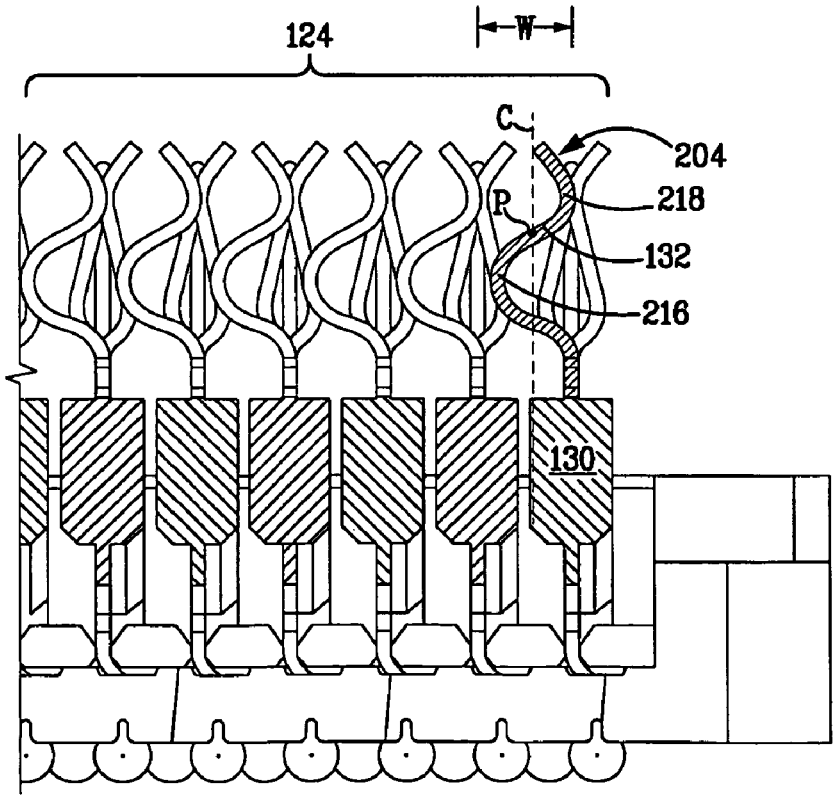

FIGS. 2A and 2B each depict an exploded view of the example receptacle contacts 122 and 124, respectively, of the receptacle connector 102 shown in FIG. 1. An example of each contact 202, 204 in each of FIGS. 2A and 2B is shaded for illustrative purposes. FIG. 2A depicts the mating portion 132 of the example receptacle contact 202, which includes a receptacle 208 for receiving a male contact, such as a blade-shaped contact 110 from header connector 104. The receptacle 208 of the contact 202 is depicted as a slot on the mating portion 132 of the receptacle contact 202 that includes at least two opposing tines 210, 212 that define the slot therebetween. The slot of the mating portion 132 may receive the blade-shaped mating portion 118 of the electrical contacts 110. The width of the slot (i.e., the distance between opposing tines)

may be smaller than the thickness of the blade-shaped mating portion 118. Thus, the opposing tines 210, 212 may exert a force on each side of a blade-shaped mating portion 118 of a contact 110 received therein, thereby retaining the mating portion 118 of the electrical contact 110 in the mating portion 132 of the electrical contact 202.

Upon insertion of the header contact 110, the opposing tines 210, 212 of the receptacle contact 206 may be separated such that a portion of the tines 210*a*, 212*a*, of adjacent contacts 206 make contact with each other. The mating receptacle and header contacts, 206, 110, may be ground contacts. Thus, the connection between a tine of a receptacle contact 206 with the tine of an adjacent receptacle contact, with header contacts 110 having a good electrical connection with the adjacent receptacle contacts, may establish a ground between the electrical contacts 122, 110.

FIG. 2B depicts a partial view of the cross-section of the receptacle connector 102, which shows a linear array of the electrical contacts 126 that extend in the first direction, which are only partially shown in FIG. 1. The mating portion 132 of the example contact 204 has a width W and includes a single tine. The receptacle contact 204 may be configured to make contact with an electrical contact 110 in the header connector 102. For example, the receptacle contact 204 may be generally s-shaped with a first portion 216 and a second portion 218.

The receptacle contact 204 may be configured to make contact with more than one electrical contact 110 in the header connector 102. The first portion 216 may make a point of contact with a header contact 110 and the second portion 218 may make another point of contact with an adjacent header contact 110. In FIG. 2B, the first portion 216 has a larger radius of curvature than the second portion. Thus, the first portion 216 extends further beyond a centerline C than the second portion 218, where the centerline C is a line drawn in the direction that the contact substantially extends from the leadframe housing 130, the line intersecting at the change in curvature point P on the S-shaped mating portion 132. As described in more detail below, the mating portion 132 may be any shape such that the receptacle contact 204 makes contact with more than one header contact 110 upon mating of the electrical connectors 102, 104. The mating receptacle and header contacts 204, 110 may be ground contacts. Thus, the mating of the receptacle contact 204 with more than one header contact 110 may thereby establish a ground between the header contacts 110.

Figure 3B:
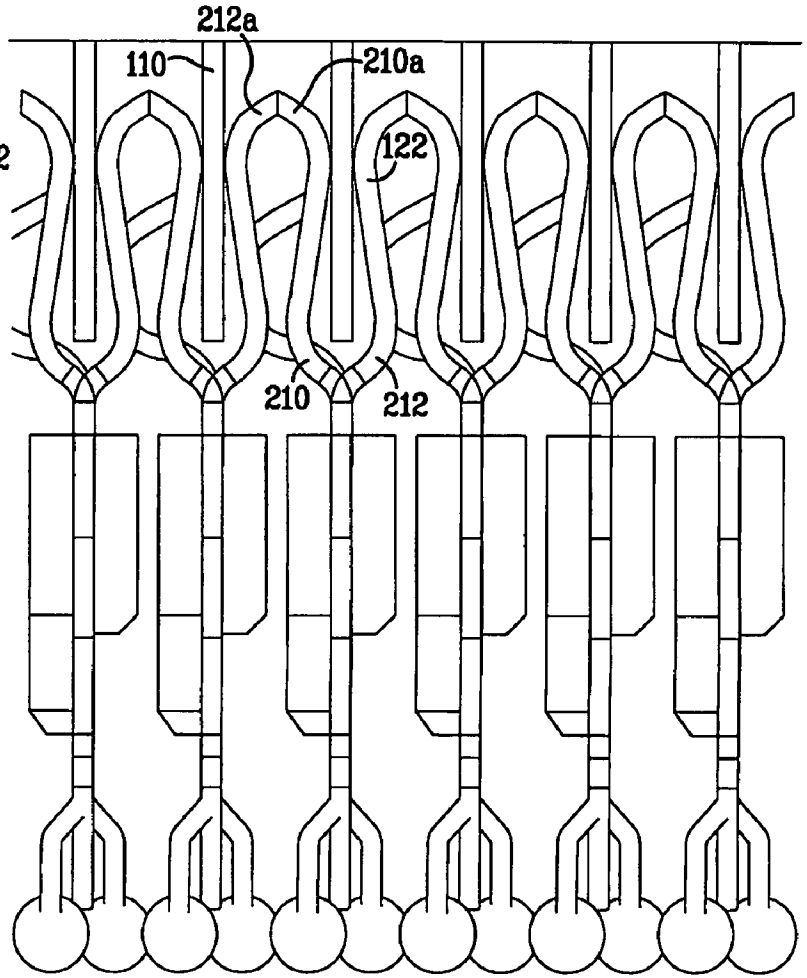
FIGS. 3A and 3B depict example mating interfaces, each having a continuous ground along an array of electrical contacts.
Figure 3A:
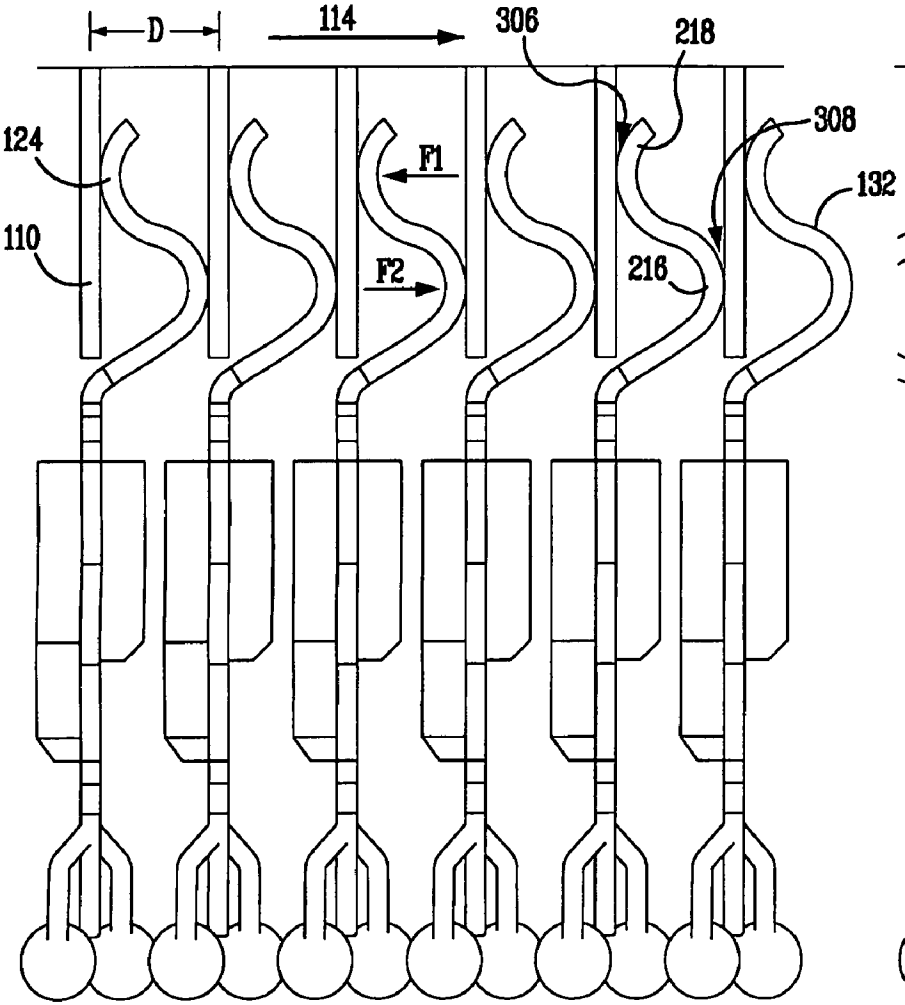

FIGS. 3A and 3B depict two example receptacle connector configurations such that a linear array of receptacle contacts engage a linear array of header contacts 110 and establish a continuous ground between the arrays. In FIG. 3A, the header contacts 110 are positioned broadside-to-broadside in an array and the receptacle contacts 124 are positioned broadside-to-broadside in an array, both arrays extending in the first direction 114. Each contact 110, 124 shown may be one contact in a respective array of contacts that extends in the second direction (i.e., into the page of FIG. 3A).

The receptacle contacts 124 may serve as bridging elements to bridge header contacts. For example, each of the receptacle contacts 124 may have a resilient mating portion 132 that is adapted to bridge together the array of ground contacts from the header connector. As the receptacle contacts 124 mate with adjacent header contacts 110, the receptacle contacts 124 may make points of contact with adjacent header contacts. Each receptacle contact 124 may make contact with more than one header contact 110. For example, the receptacle mating portions 132 may be generally S-shaped with a first curved portion 218 that makes a single point of contact 306 with a first header contact 110, and a second curved portion 216 that simultaneously makes a single point of contact 308 with a second header contact 110 that is adjacent to the first header contact 110. Thus, the receptacle contact 124 interconnects the first and second header contacts 110.

The mating portion 132 of the receptacle contact may have a variety of shapes and sizes. For example, the first curved portion 218 shown has a smaller radius of curvature than the radius of curvature of the second curved portion 216 shown. Upon insertion of a receptacle contact 124 between two adjacent header contacts 110, the first curved portion 218 may make an initial contact 306 with a first header contact 110. As the receptacle contact 124 is inserted further, the second curved portion 216 may make contact 308 with an adjacent, second header contact 110.

The receptacle contacts 124 may bridge together an array of header contacts 110. Each header contact 110 may be housed in a respective leadframe assembly. Thus, the receptacle contacts 124 may bridge together header contacts 110 across a plurality of leadframe assemblies. The receptacle contacts 124 and the header contacts 110 may be ground contacts. A common ground may be established between the header contacts 110 in the first direction, and the common ground may be established across contacts 110 housed in a plurality of leadframe assemblies. Such bridging establishes a common ground along the array of header contacts 110, which tends to reduce time domain frequency crosstalk.

The distance D between the header ground contacts 110 may be smaller than the width W of an unmated receptacle contact 124, as shown in FIG. 2B, that is to be inserted between adjacent header contacts 110. As the contacts 110, 124 are mated, the resilient mating portion 132 of the receptacle contact 124 may flex to accommodate the insertion of each receptacle contact 124 between adjacent header contacts 110. The insertion may result in a force normal F1, F2 to each of the receptacle/header contact mating surfaces. The opposing forces F1, F2 on each side of the receptacle contact 124 mating portion 132 may thereby establish a good electrical connection between contacts 124 and 110.

The receptacle contacts and header contacts are not limited to the sizes and shapes described herein. For example, the receptacle contact may be of any shape suitable for establishing a ground along a linear array of ground contacts. FIG. 3A depicts a single-tine receptacle contact 124 that is shaped to bridge together at least two blade-shaped header contacts 110 by making multiple points of contact between header contacts 110. Alternately, FIG. 3B depicts a dual-tine receptacle contact, such as contact 122, shaped to receive a blade-shaped contact 110 which creates a force that separates the tines 210, 212. The force may be sufficient to result in contact between adjacent tines 210*a* and 212*a* from different receptacle contacts, thus establishing a ground.

In FIG. 3B each contact 110, 122 shown may be one contact in a respective array of contacts that extends in the second direction (i.e., into the page of FIG. 3B). The opposing tines 210, 212 of the receptacle contact 206 may be separated as a result of the insertion of the header contact such that a portion of the tines 210*a*, 212*a*, of adjacent contacts 206 make contact with each other. The receptacle contacts 122 may bridge together the array of receptacle contacts 122 and header contacts 110. Each header contact 110 may be housed in a respective leadframe assembly. Thus, the receptacle contacts 122 may bridge together contacts 110, 122 across a plurality of leadframe assemblies. The receptacle contacts 122 and the header contacts 110 may be ground contacts. A common ground may be established between the contacts 110, 122 in the first direction, and the common ground may be established across contacts 110, 122 housed in a plurality of leadframe assemblies. Such bridging establishes a common ground along the array of receptacle and header contacts 122, 110, which may reduce time domain frequency crosstalk.

Figures 4A, 4B:
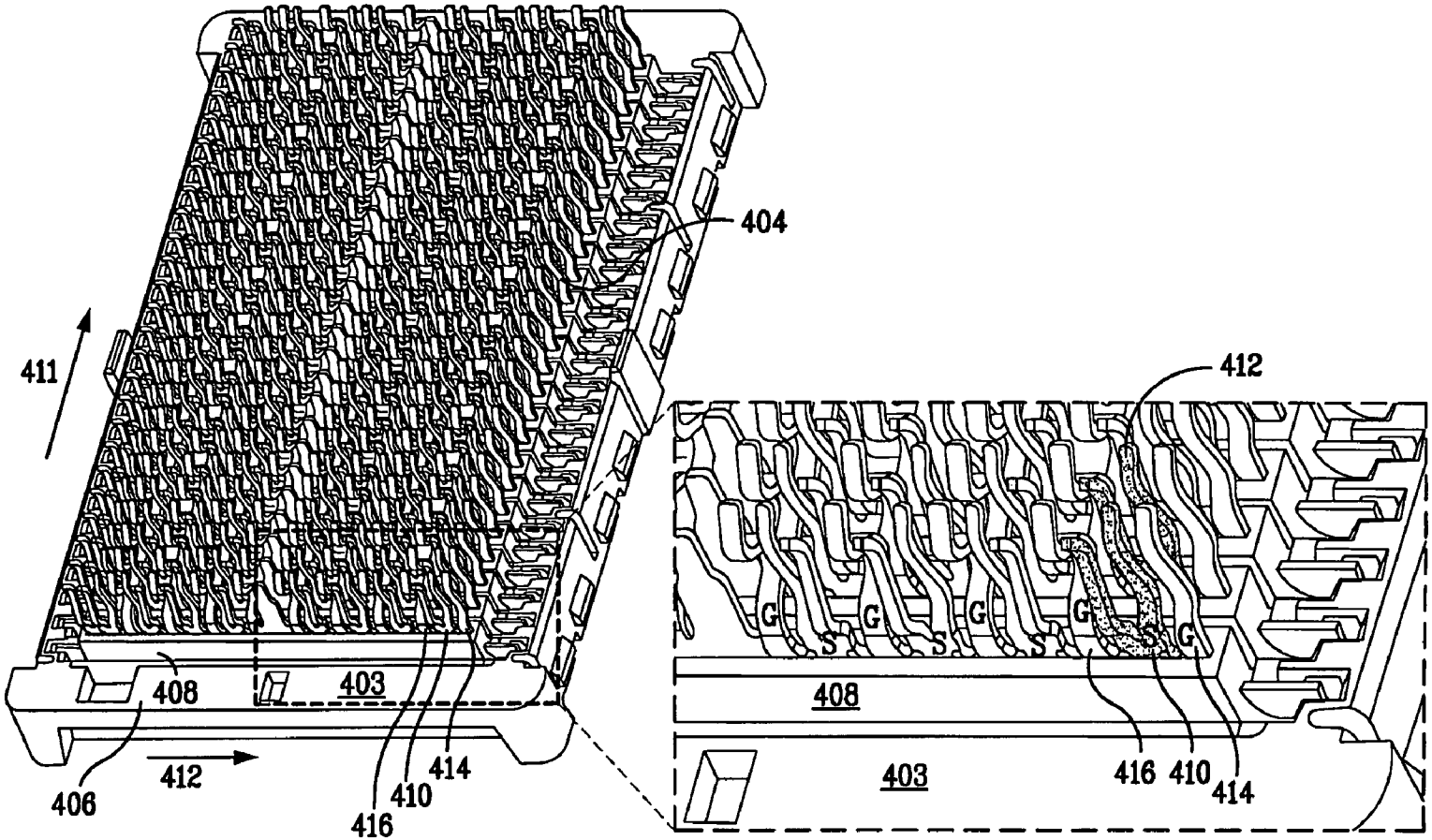
FIG. 4A depicts an isometric view of a receptacle connector absent a top portion of the connector housing.
FIG. 4B depicts an exploded view of a section of the receptacle connector depicted in FIG. 4A.

FIG. 4A depicts an isometric view of a receptacle connector 402 with the top portion of the connector housing 403 removed. FIG. 4B depicts an exploded view of a section of contacts from the receptacle connector 402. The receptacle connector 402 may include a receptacle connector housing 403 which may be made of dielectric material, such as plastic, thermoplastic, or the like. The housing 403 may be manufactured by any technique, such as injection molding, for example.

The receptacle connector 402 may contain an array of electrically conductive contacts 404 that define a mating region. The electrical contacts 404 may be housed in insert molded leadframe assemblies (IMLAs) 408. Each IMLA 406 may include a leadframe housing 408 through which the contacts 404 at least partially extend. The leadframe housing 408 may be made of a dielectric material, such as plastic, for example. The IMLAs may be positioned adjacent to each other in a linear array that extends in direction 411 or 412. FIGS. 4A and 4B depict a linear array of IMLAs extending in the first direction, each IMLA housing an array of contacts positioned edge-to-edge. Thus, the broadsides of each contact 404 in each IMLA 406 may be adjacent to the broadside of another contact 404 from an adjacent IMLA 406, thereby creating a plurality of arrays of contacts positioned broadside-to-broadside along the first direction 411.

The electrical contacts 404 may include both signal contacts and ground contacts that vary in arrangement. For example, along each array that extends in the first or first direction, the contacts 404 may be in a signal-ground-signal arrangement, a ground-signal-ground-signal arrangement, or a ground-signal-signal arrangement. A plurality of differential signal pairs may be positioned adjacent to one another along the first direction or along the second direction, forming either broadside-coupled or edge-coupled differential signal pairs. FIGS. 4A and 4B depict a ground-signal-ground-signal arrangement positioned edge-to-edge along in arrays extending in the second direction with broadside-coupled differential signal pairs in arrays extending in the first direction. For example, from right to left in the first IMLA shown in FIG. 4B, 414 is a ground contact, 410 is a signal contact, 416 is a ground contact, and so on. Contact 412 may form a differential signal pair with contact 410. Contacts 410 and 412 are shaded for illustrative purposes.

The contacts in the receptacle connector 402 may be of varying shapes and sizes. FIGS. 4A and 4B show a different contact shape for each mating portion of contacts 414, 410, and 416. As shown, the mating portions may include one or more tine. For example, the mating portion may be a dual-beam receptacle contact interface such as the mating portion of contact 410, adapted to engage respective blade-shaped contacts from the header connector. As described herein, ground contact 416 is shaped such that contact may be made with more than one header contact 110 when the receptacle connector 402 is mated with a header connector. Thus, when the receptacle connector 402 is mated to a header connector, a continuous ground may be established along a linear array of ground contacts in a direction 411 that begins with ground contact 416. FIG. 4A depicts a plurality of linear arrays of ground contacts with the shape of ground contact 416. Thus, a plurality of continuous grounds may be established along the direction 411. Each of the ground contacts 404 in the linear array in the direction 411 are housed in respective IMLAs. Thus, the continuous grounds are established along the direction 411 between ground contacts 404 across a plurality of IMLAs 408. The contacts 404 are not limited to the sizes and shapes described herein for the establishment of a continuous ground. For example, the receptacle contact 416 may be of any shape suitable for establishing a ground along a linear array of complementary ground contacts.

Figure 5B:
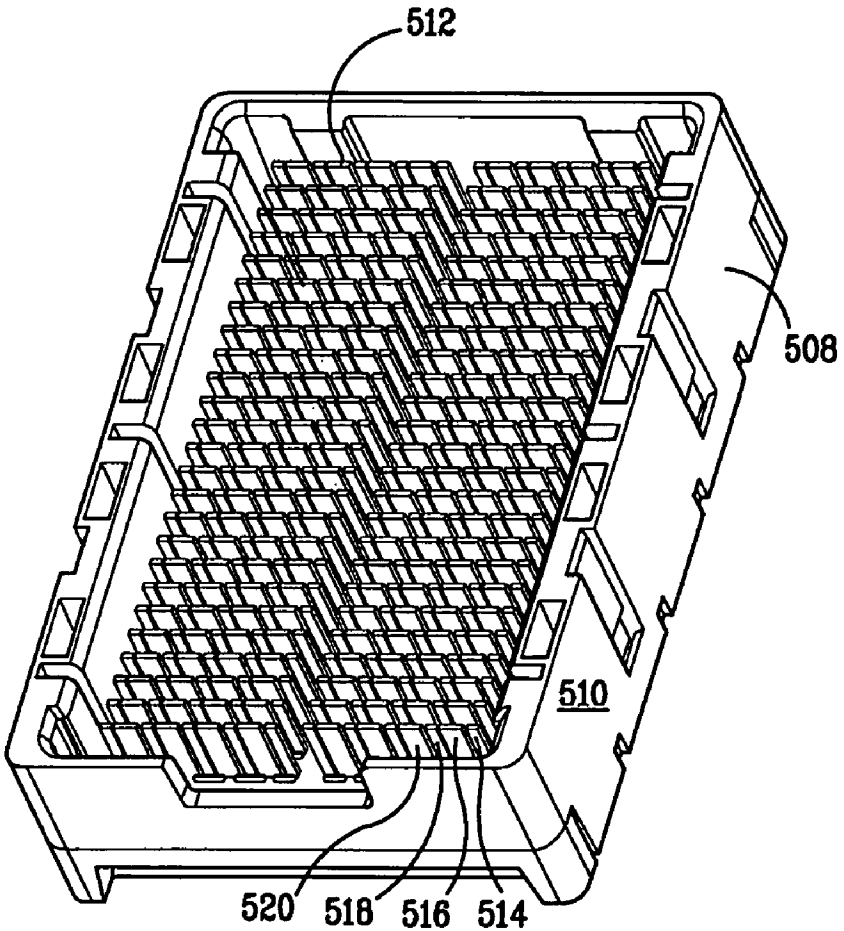
FIG. 5B depicts a header connector that is suitable for mating with the receptacle connector of FIG. 5A.
Figure 5A:
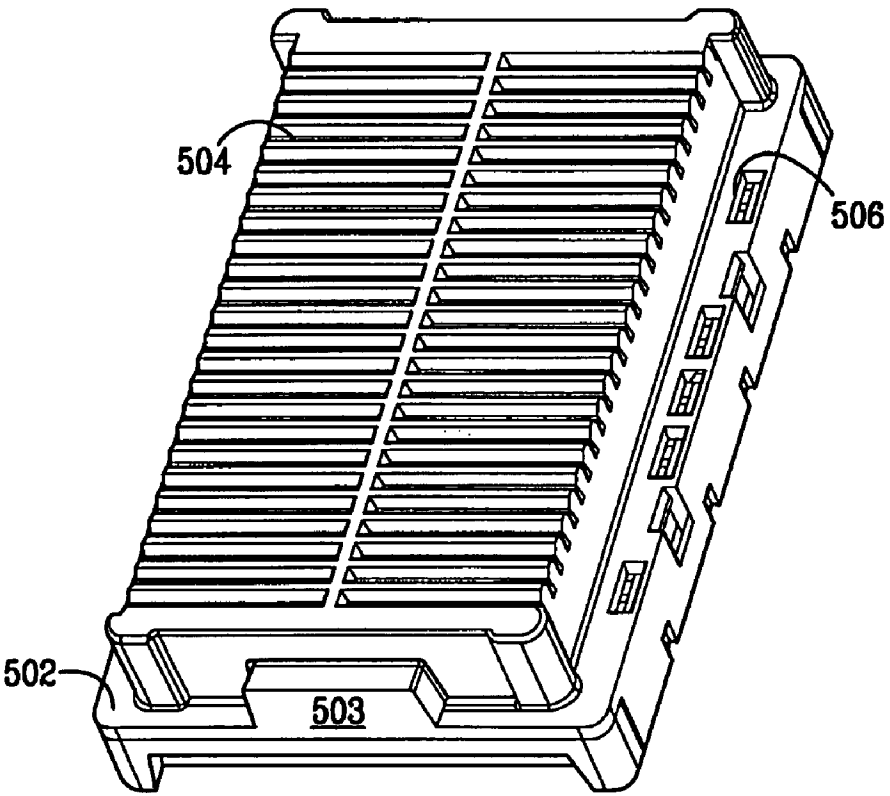
FIG. 5A depicts the receptacle connector of FIG. 3A with the entire connector housing.

FIG. 5A depicts a receptacle connector 502 that is the receptacle connector 402 of FIG. 4A with the connector housing 503 fully intact. Disposed in each aperture 504 is an array of electrical contacts 404 positioned edge-to-edge in an IMLA 408, as described with respect to FIG. 4A. There are a plurality of latching mechanisms 506 formed in the connector housing 503 that are adapted to latch with complementary latching mechanisms formed in the housing of a complementary connector, such as the header connector 508 depicted in FIG. 5B.

FIG. 5B depicts the header connector 508 that may mate with the receptacle connector 502 of FIG. 5A. The header connector 508 may include a connector housing 510 and electrical contacts 512 extending therethrough. The electrical contacts 512 may be arranged in linear arrays and each contact 512 may have a cross-section that defines two opposing edges and two opposing broadsides.

The electrical contacts 512 may include both signal contacts and ground contacts that vary in size and arrangement. For example, along each array extending in the first or first direction, the contacts may be in a signal-ground-signal arrangement, a ground-signal-ground-signal arrangement, or a ground-signal-signal arrangement. As a complementary connector to the receptacle connector 502, the contacts in the header connector 508 are arranged in a ground-signal-ground-signal arrangement and are positioned edge-to-edge in an array extending in the second direction and broadside-to-broadside in an array extending in the first direction. For example, from right to left in the first array of contacts in the header connector 508 are ground contact 514, signal contact 516, ground contact 518, signal contact 520, and so on.

Each of the contacts 512 in the header connector 508 may have a respective mating portion that may be of varying shapes and sizes. For example, the ground contacts, such as example contact 514, are shown having a broadside that is less broad than the broadsides of the signal contacts, such as example signal contact 516. The mating end of each electrical contact 512 may be blade-shaped and may be adapted to mate with a respective electrical contact of the receptacle connector 502.

The header connector 508 may be mated to the receptacle connector 502 until the connector housing 510 of the header connector 508 abuts the connector housing 503 of the receptacle connector 502. The contact mating portions that are disposed in each aperture 504 in the receptacle connector 502 may mate with the contact mating portions of the header connector 508. As described herein, the ground contacts in the receptacle connector 502 may be shaped to bridge together a linear array of ground contacts 512 in the second connector when the connectors 502, 508 are mated. Thus, a ground may be established between the connectors 502, 508 by the mating of ground contacts 404, 512 from the respective connectors 502, 508. Such bridging tends to establish a continuous ground along a linear array of ground contacts, such as an array of header contacts extending in the first direction and starting with contact 518, which thereby creates a more robust ground.

Figure 6:
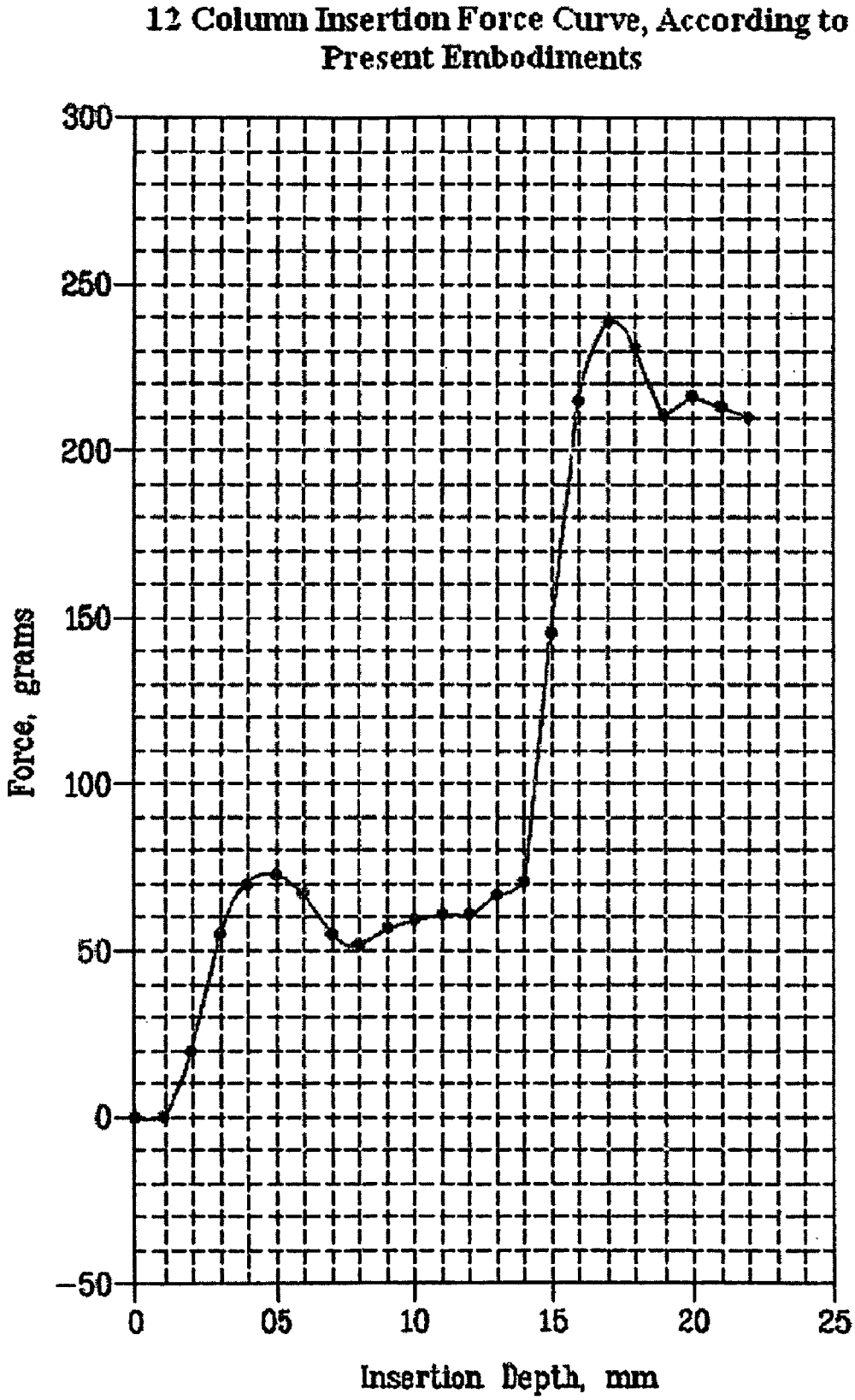
FIG. 6 provides a graphical representation of insertion force as a function of insertion depth.

FIG. 6 is a graphical representation of the insertion force that results when the receptacle contact is inserted between more than one header contact. Upon insertion of a receptacle contact 124 between two adjacent header contacts 110, a first portion of the receptacle contact 218 may make an initial contact with a first header contact 110. As the receptacle contact is inserted further, a first portion 216 may make contact with an adjacent, second header contact 110. The resilient mating portion 132 of the receptacle contact 124 may flex to accommodate the insertion of the receptacle contacts 124 between the header contacts 110, where the width of the receptacle contact 124 is greater than the distance between the header contacts 110.

The force may elongate the receptacle contact 124 and result in a force normal to each of the receptacle/header contact mating surfaces, such as at the points of contact 306, 308. The force exerted may retain the mating portion 132 of the receptacle contact 124 between the adjacent header contacts 110. Thus, a better electrical connection between the contacts 110, 124, as well as between the contacts 110, 122 may be made and sustained. As indicated, the deeper the insertion, the greater the resulting force. The increase in force may correspond to the insertion of the receptacle contact at the point where the first portion 216 of the receptacle contact 124 makes contact with the second header contact 110.

What is claimed:

1. A first connector configured to engage a complementary second connector, the second connector comprising a plurality of first and second ground contacts, arranged such that each first ground contact is positioned adjacent to a second ground contact, the first connector comprising:

a connector housing; and a plurality of third ground contacts that are each adapted to make a first point of contact with a respective one of the first ground contacts and simultaneously make a second point of contact with a respective one of the second ground contacts, such that adjacent ground contacts are electrically connected to each other so as to form a continuous ground path across the plurality of third ground contacts.

2. The first connector of claim 1, wherein at least one of the third ground contacts has a first curved portion that is adapted to make the first point of contact with the respective first ground contact and a second curved portion that is adapted to make the second point of contact with the respective second ground contact.

3. The first connector of claim 2, wherein at least one of the third ground contacts has a generally s-shaped portion.

4. The first connector of claim 2, wherein the second curved portion has a larger radius of curvature relative to the first curved portion.

5. The first connector of claim 1, wherein at least one of the third ground contacts interconnects the first and second ground contacts.

6. The first connector of claim 1, wherein at least one of the third ground contact establishes a continuous ground between the respective first and second ground contacts.

7. The first connector of claim 1, wherein at least one of the third ground contacts has a resilient portion that is adapted to exert a respective normal force on each of the respective first and second ground contacts during mating of the first and second connectors.

8. An electrical connector system, comprising:

a first electrical connector comprising a first array of first ground contacts arranged along a second direction;

a second electrical connector comprising a second array of second ground contacts arranged along the second direction, wherein the second ground contacts engage the first ground contacts so as to establish a continuous ground path across the first and second arrays of first and second ground contacts along the second direction.

9. The electrical connector system of claim 8, wherein the second array of second ground contacts comprises at least one second ground contact shaped to make contact with an adjacent second ground contact, thereby establishing the continuous ground.

10. The electrical connector system of claim 8, wherein the first ground contacts are arranged broadside-to-broadside relative to one another along the second direction and the second ground contacts are arranged broadside-to-broadside relative to one another along the second direction.

11. The electrical connector system of claim 8, wherein the electrical connector system further comprises a third array of electrical contacts arranged along a first direction that is perpendicular to the second direction.

12. The electrical connector system of claim 11, wherein the electrical contacts in the third array are arranged edge-to-edge along the first direction.

13. The electrical connector system of claim 11, wherein each of the first ground contacts is housed in a respective leadframe assembly, and the continuous ground is established across a plurality of leadframe assemblies.

14. A first connector configured to engage a complementary second connector, the second connector comprising first and second ground contacts positioned adjacent to one another, the first connector comprising:

a connector housing; and an adjacent pair of third ground contacts that are each adapted to receive a different one of the first and second ground contacts, wherein each of the third ground contacts expand toward each other upon receiving the first and second ground contacts, respectively, such that the third ground contacts make contact with each other so as to establish a continuous ground path between the first and second ground contacts.

15. The first connector of claim 14, wherein the third ground contacts do not contact each other prior to receiving the first and second ground contacts.

16. A first connector configured to engage a complementary second connector, the first connector comprising:

a connector housing; and a first IMLA supported by the connector housing and a second IMLA supported by the connector housing and disposed adjacent to the first IMLA, each IMLA including a leadframe housing that retains an array of ground contacts and signal contacts, wherein the ground contacts of the first and second IMLAs each defines a mounting portion configured to engage a substrate, and a contact portion connected to the mounting portion, and the contact portion of at least a select ground contact of the ground contacts of the first IMLA is electrically connected with the contact portion of a select ground contact of the ground contacts of the second IMLA so as to establish a common ground across the contact portions of the select ground contacts of the first and second IMLAs.

17. The first connector as recited in claim 16, wherein the second connector comprises first and second ground contacts, and the select contact of the first IMLA is adapted to make a first point of contact with the first ground contact of the second connector, and simultaneously make a second point of contact with the second ground contact of the second connector.

18. The first connector of claim 17, wherein the select ground contact of the first IMLA has a generally s-shaped portion having a first curved portion that is adapted to make the first point of contact with the first ground contact of the second connector and a second curved portion that is adapted to make the second point of contact with the second ground contact of the second connector.

19. The first connector of claim 18, wherein the second curved portion has a larger radius of curvature relative to the first curved portion.

20. The first connector of claim 16, wherein the second connector comprises first and second ground contacts, and the select ground contacts of the first and second IMLAs are each adapted to receive a different one of the first and second ground contacts of the second connector, such that each of the select ground contacts expand toward each other upon receiving the first and second ground contacts of the second connector so as to make contact with each other.

* * * * *